United States Patent [19]

Tokuda et al.

[11] Patent Number: 4,682,882

[45] Date of Patent: Jul. 28, 1987

[54] IMAGE RECORDING APPARATUS

[75] Inventors: Wahei Tokuda; Atushi Takagi, both of Tokyo, Japan

[73] Assignee: Canon Kabushiki Kaisha, Tokyo, Japan

[21] Appl. No.: 870,424

[22] Filed: Jun. 4, 1986

Related U.S. Application Data

[63] Continuation of Ser. No. 645,402, Aug. 29, 1984, abandoned.

[30] Foreign Application Priority Data

Sep. 5, 1983 [JP] Japan ..... 58-161948

[51] Int. Cl.[4] ..... G03G 15/06; G03G 21/00

[52] U.S. Cl. ..... 355/14 D; 355/14 R

[58] Field of Search ..... 355/3 R, 14 R, 14 D, 355/14 E

[56] References Cited

U.S. PATENT DOCUMENTS

| | | | |
|---|---|---|---|
| 4,215,930 | 8/1980 | Miyakawa et al. | 355/14 D |
| 4,239,374 | 12/1980 | Tatsumi et al. | 355/14 D X |
| 4,266,870 | 5/1981 | Eda et al. | 355/14 D |
| 4,277,549 | 7/1981 | Tatsumi et al. | 355/14 D X |

*Primary Examiner*—Fred L. Braun

*Attorney, Agent, or Firm*—Fitzpatrick, Cella, Harper & Scinto

[57] ABSTRACT

A image recording apparatus capable, in the measurement of the background density of an original image, of detecting and omitting an area exceeding a determined width and a determined density in the determination of the background density, thus avoiding incorrect reproduction of background density. A signal output is provided upon detection of image density past the determined width, and the detected image density data is corrected in response to that signal output.

16 Claims, 15 Drawing Figures

IMAGE RECORDING APPARATUS

This is a continuation of application Ser. No. 645,402, filed Aug. 29, 1984, now abandoned.

BACKGROUND OF THE INVENTION

1. Field of the Invention

The present invention relates to an image recording apparatus capable of controlling image recording conditions according to the density of the original image.

2. Description of the Prior Art

There are already known image recording apparatus, such as copiers, which measure the background density of an original image in response to a detection signal from density detecting means for detecting the image density of the original image and accordingly controls certain image recording conditions such as the amount of image exposure or the image developing condition, thereby automatically obtaining an appropriate density in the reproduced image.

As examples of such an image recording control device for controlling the image recording conditions through the detection of the original image density, Japanese Patent Laid-open No. 42856/1975 and Japanese Patent Laid-open No. 2134/1979 disclose a system in which the original image density is directly detected by an optical sensor positioned close to the optical system for such control. In such known system, the original image density or the background density is measured by reading the integrated value in the scanning of the original image with the optical system, or by reading the minimum value in the detection signal from said optical sensor.

There is also known a system in which the image recording conditions are controlled by detecting, with a potential sensor, the surface potential of a photosensitive member, which corresponds to the original image density, and the background density of the original image is determined, in the similar manner as in the aforementioned case of density detection with the optical sensor, by reading the integrated value or the minimum value in the scanning direction.

However, such conventional image recording control device may not be able to properly control the image recording conditions for certain original images since, as mentioned above, the background density of the original image is determined by reading the integrated value or the minimum value, in the scanning direction, of the detection signal from the density detecting means for detecting the original image density.

For example, the background density determined by the integrated value of the density detection signal in the scanning direction is close enough to the actual background density in case the original image contains a large proportion of the background or contains characters and fine lines as the image, as shown in FIG. 1A. However, if the original image contains a wide black image area as shown in FIG. 1B, the background density determined from the integrated value becomes significantly different from the actual background density. This is due to the limit in the resolving power of the optical or potential sensor employed for detecting the original image density, as characters and fine lines (0.1–0.5 mm in width) cannot be resolved by such sensor while a broad line exceeding a certain width and a certain density level can be resolved. More specifically, such sensor with an insufficient resolving power senses characters and fine lines only as a part of the background, but the background density thus determined approximately coincides with the actual background density since in most originals the characters and fine lines only represent about 10 per cent of the entire area. However, a broad line (exceeding 5 mm in width) as shown in FIG. 1B can be easily detected with a sensor of a low resolving power, so that the background density determined from the integrated value of the sensor signal in the scanning direction always becomes higher than the actual background density because the obtained integrated value contains such broad line as a part of the background. The image recording control in such state tends to obtain an appropriate contrast by compensating the apparently elevated background density. More specifically, as the sensor reads a so-called background smudge of the original, there is conducted a compensating process, for example by increasing the exposure to the photosensitive member, whereby the reproduced image becomes generally thinner.

Also the background density determined from the minimum value of the density detection signal may become significantly different from the actual background density in certain original images, and is therefore unable to provide the reproduced image of an appropriate density.

SUMMARY OF THE INVENTION

In consideration of the foregoing, an object of the present invention is to provide an improved image recording apparatus capable of controlling image recording conditions according to the density of the original image.

Another object of the present invention is to provide an image recording apparatus capable of precise measurement of the original image density, thus obtaining a reproduced image of an appropriate density.

Still another object of the present invention is to provide an image recording apparatus capable of detecting, in the measurement of the original image density, the continuation over a determined width of the image density exceeding a determined level.

Still another object of the present invention is to provide an image recording apparatus capable of disregarding an image density exceeding a determined level and continuing over a determined width or converting such image density into another density level.

The foregoing and still other objects of the present invention will become fully apparent from the following description.

BRIEF DESCRIPTION OF THE DRAWINGS

FIG. 1 shows charts representing density distribution of original image, wherein

DETAILED DESCRIPTION OF THE PREFERRED EMBODIMENTS

Now the present invention will be clarified in detail by an embodiment shown in the attached drawings.

At first reference is made to FIG. 2 showing the outline of the present invention.

Figure 1B:
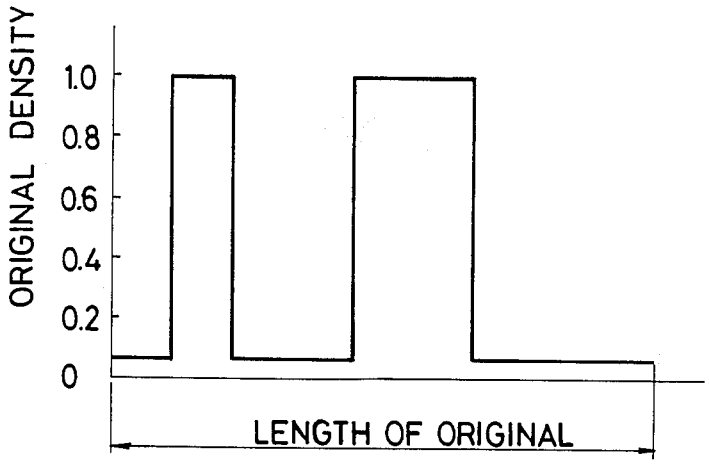
Figure 2A:
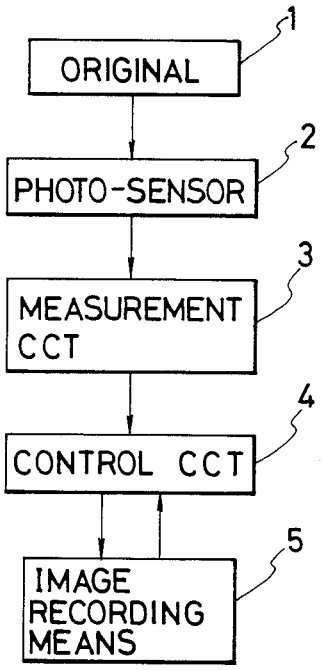
FIGS. 2A and 2B are block diagrams showing the outline of the present invention.

As shown in FIG. 2A, there is provided a photosensor 2 as density detecting means for detecting the image density of an original 1 by measuring the light reflected or transmitted by said original, and a measuring circuit 3 reads the integrated value in the scanning direction to determine the background density of the original 1. In response to said measurement a control circuit 4 controls the image recording conditions in image recording means 5 for image recording. The measuring circuit 3 or the control circuit 4 is equipped with detection means for detecting the continuation of an image density exceeding a determined level over a determined width in the original scanning, and, upon detection of a broad black line as shown in FIG. 1B, the detection signal of the photo-sensor 2 corresponding to such line is disregarded in the integration to provide an exact background density of the original.

Figure 2B:
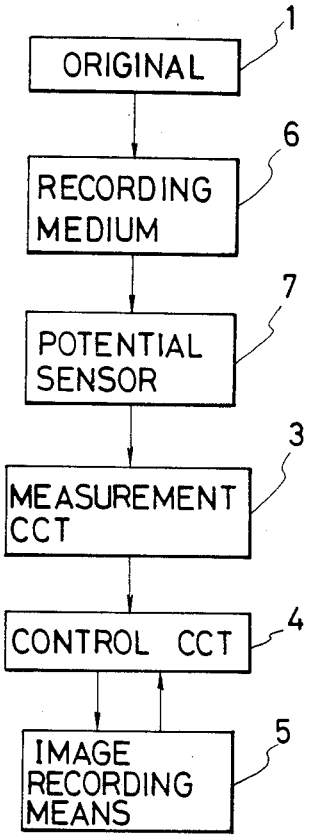

It is also possible, as shown in FIG. 2B, to measure the background density of the original by forming an electrostatic latent image corresponding to the original image on the surface of a photosensitive member 6 and measuring the surface potential of said image by means of a potential sensor 7.

Examples of the image recording conditions of the image recording means 5 to be controlled by the control circuit 4 are the amount of charging to be given to the recording member 6, amount of exposure to be given thereto, and developing condition thereof.

The reproduced image of an appropriate density without background smudge can also be obtained by converting the unnecessary detection signal from said detection means into a detection signal corresponding to the background density of the original 1, instead of omitting such unnecessary detection signal.

Figure 3:
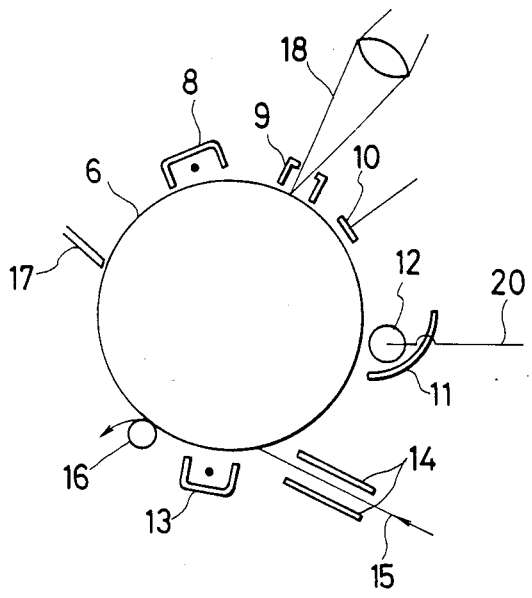
FIG. 3 is a schematic view showing an electrophotographic copier embodying the present invention.

FIG. 3 shows an electrophotographic copier embodying the present invention.

In FIG. 3 there are shown a recording member 6 composed of a drum-shaped photosensitive member; a primary charger 8 for uniformly charging said recording member 6 positively or negatively prior to imagewise exposure; a secondary charger 9 for charge elimination of the recording member 6 simultaneous with imagewise exposure corresponding to the original image; a potential sensor 10 positioned close to the surface of the recording member 6; a developing unit 11; a developing sleeve 12; a transfer charger 13 for transferring the toner image onto a copy sheet wound on an unrepresented transfer drum; a transfer guide 14 for the copy sheet 15; a separating roller 16 for separating the copy sheet 15; and a cleaning blade 17 for recovering the remaining toner.

The function of the above-described apparatus is as follows.

Figure 4:
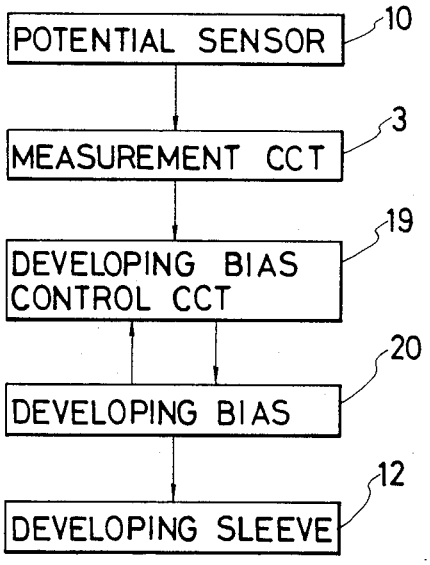
FIG. 4 is a block diagram showing the principle of developing bias control.
Figure 5A:
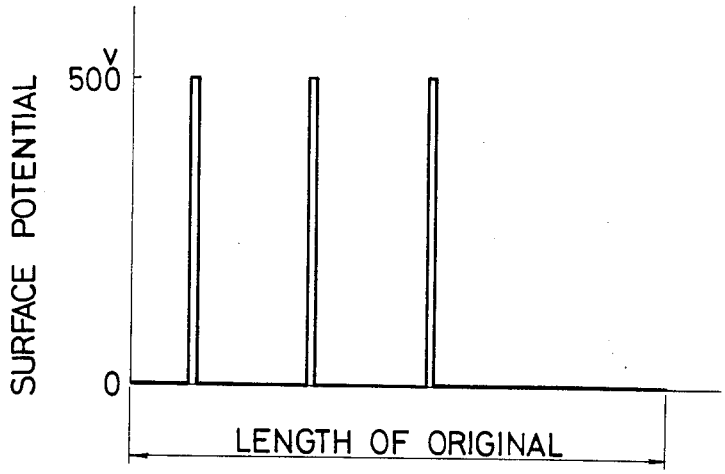
FIGS. 5A and 5B are charts showing the surface potentials detected from the originals shown in FIG. 1.
Figure 5B:
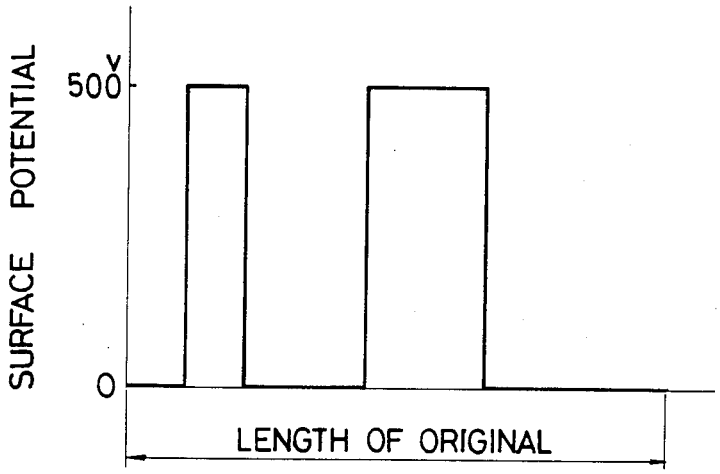

Prior to the original scanning for copying, there is conducted a preliminary scanning for measuring the original image density. In said preliminary scanning, the recording member 6 is exposed to the light reflected or transmitted by the original image to generate surface potentials corresponding to the original image density. Said potentials are detected by the potential sensor 10, and a measuring circuit 3 shown in FIG. 4 reads the integrated value in the scanning direction to measure the background density of the original. In response to the result of said measurement, a developing bias control circuit 19 controls the developing bias 20, thus controlling the image recording condition by suitably regulating the bias voltage supplied to the developing sleeve 12. Subsequently there is conducted an original scanning for copying, and the electrostatic latent image formed on the recording member 6 under the appropriately controlled conditions is rendered visible in the developing unit 11 to provide a reproduced image of an appropriate density.

In the following there will be given a more detailed explanation on the above-described image forming process.

As an example, in case the recording member 6 has a light potential $V_D$ (surface potential corresponding to light reflected from a standard white board) equal to 0 V and a dark potential $V_D$ equal to 500 V, an appropriate reproduced image can be obtained by providing the developing sleeve 12 with a bias voltage with an amplitude of 1200 V, a frequency of 800 Hz and a DC component of 100 V.

Figure 1A:
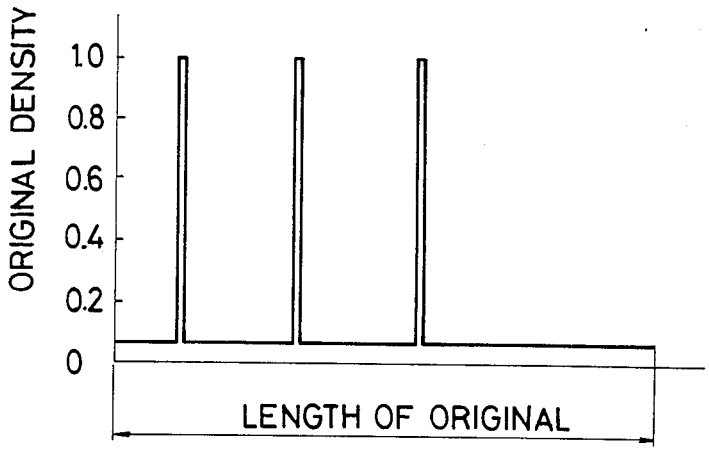
FIG. 1A shows the density distribution of an original image not containing a broad line and FIG. 1B shows that of an original image containing a broad line.
Figure 6A:
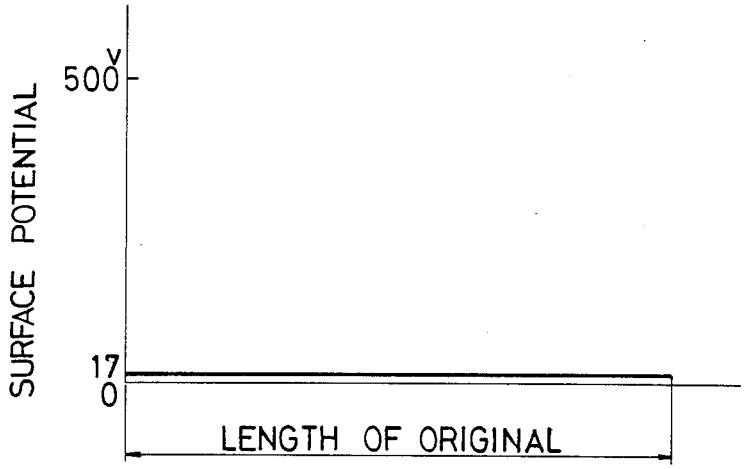
FIGS. 6A and 6B are charts showing the integrated values of the surface potentials shown in FIGS. 5A and 5B.
Figure 6B:
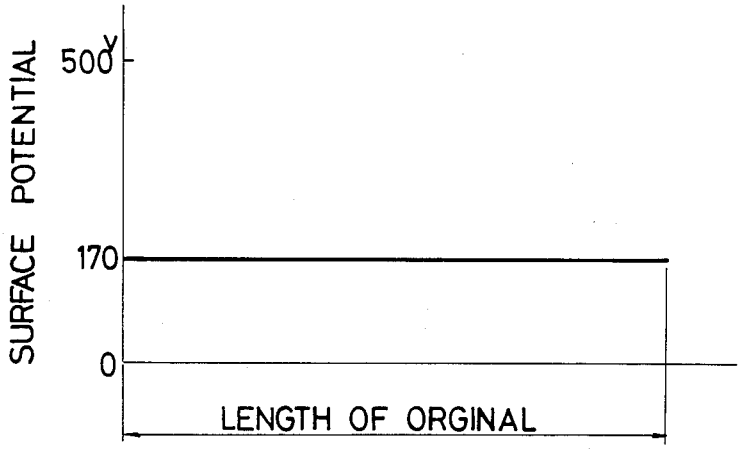
Figure 7:
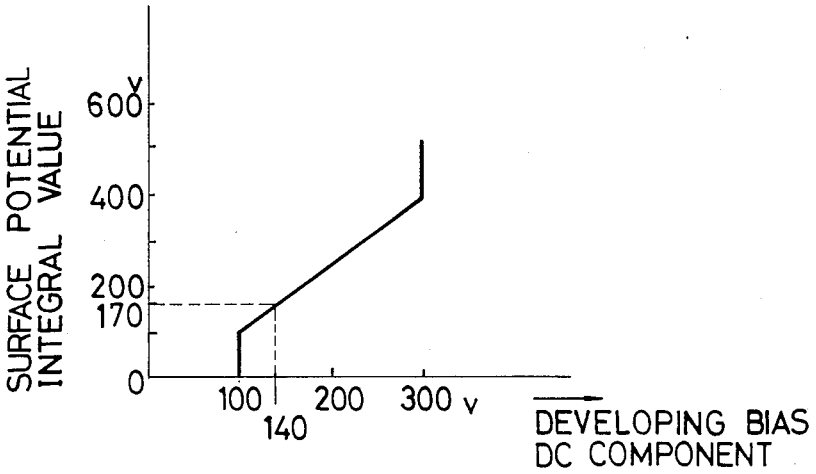
FIG. 7 is a chart showing the relationship between the integrated value of the surface potential and the DC component of the developing bias.

In the conventional process, in the measurement of the reflection density with the potential sensor 10, the originals shown in FIGS. 1A and 1B provide a surface potential of 500 V in the area with the reflective density of 1.0 (high density area), and a surface potential of 0 V in the background area. In the integration of the surface potential by the measuring circuit 3 over the entire length of the original, the originals shown in FIGS. 1A and 1B respectively provide results shown in FIGS. 6A and 6B, i.e., 17 V and 170 V. FIG. 7 shows the relationship between the thus obtained surface potential and the developing bias. Thus, for an original shown in FIG. 1A, there is obtained a DC component of 100 V for the developing bias for proper image recording. On the other hand, for an original shown in FIG. 1B, there is obtained a DC component of 140 V though in fact a DC component of 100 V is appropriate for image recording. Consequently the obtained image has a low density and lacks enough tonal rendition.

Figure 8:
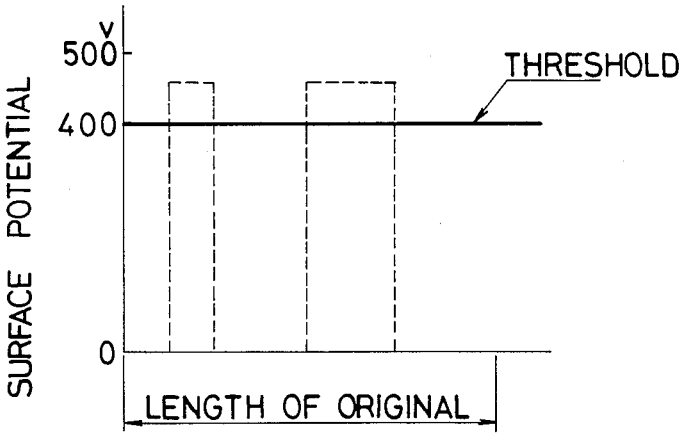
FIG. 8 is a chart showing potentials corrected from the surface potentials corresponding to the original shown in FIG. 1B.

In an embodiment of the present invention, the measuring circuit 3 identifies that the surface potential of the recording member 6, measured by thc potential sensor 10, lasts over a distance of 5 to 10 mm at a value in excess of 400 V, and a limiter circuit to be explained later skips such surface potential. Thus the original shown in FIG. 1B is measured to present a surface potential of 0 V over the entire length thereof as shown in FIG. 8. Consequently the measured background density is substantially equal to the actual background density, so that an image of an appropriate density can be obtained.

As explained in the foregoing, it is rendered possible to obtain the copy image of an appropriate density even from an original containing a broad black line or even in the case of a copying operation with the original cover left open, by skipping the detection signal of the potential sensor 10 for detecting the image density, or the photo-sensor 2 for measuring the light reflected or transmitted by the original in case an image density exceeding a determined threshold value lasts over a determined width, or converting such detection signal to another detection signal corresponding to the background density.

Figure 9A:
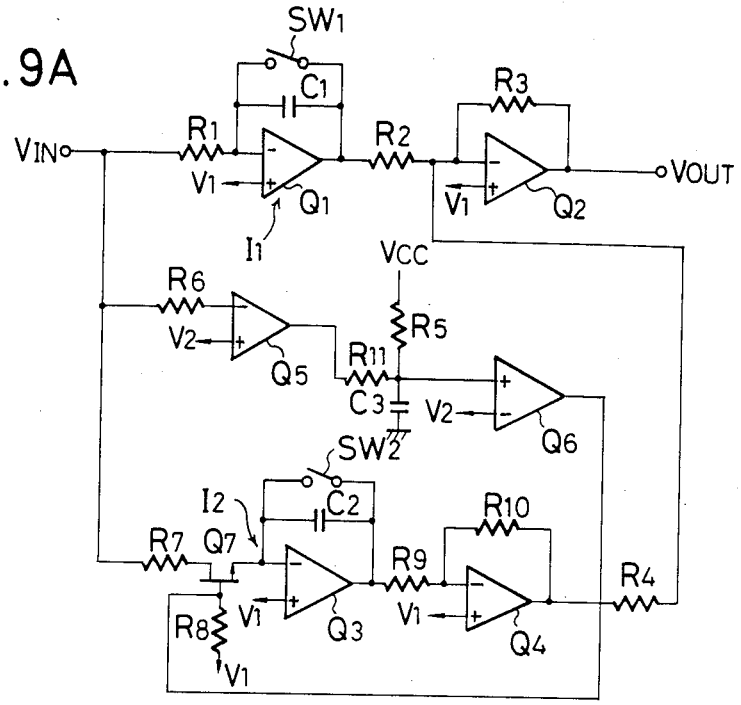
FIGS. 9A and 9B are circuit diagrams showing an example of a limiter circuit.
Figure 9B:
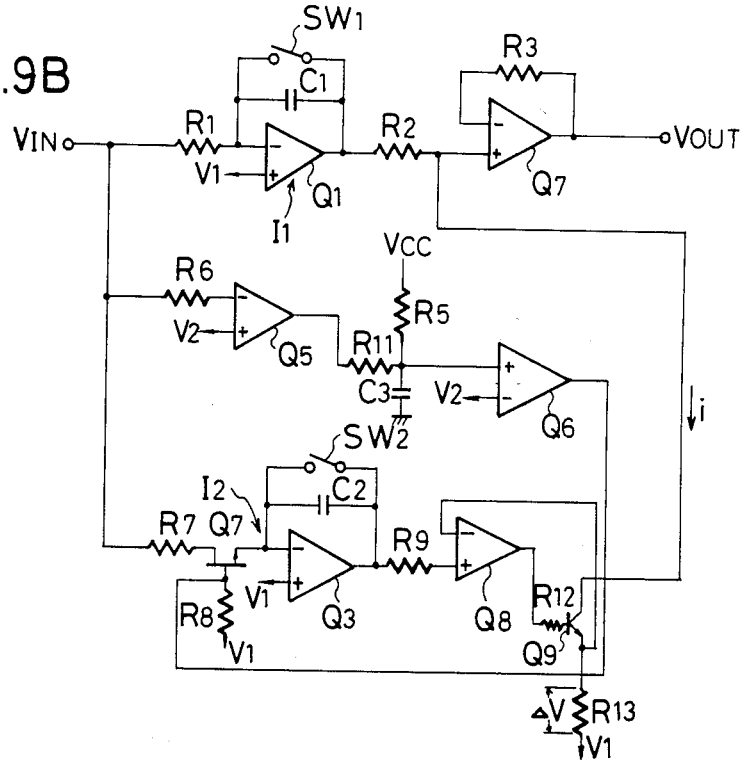

FIGS. 9A and 9B show examples of the aforementioned limiter circuit, wherein resistors R1–R11; condensers C1–C3; operational amplifiers Q1–Q4; comparators Q5, Q6; and an FET Q7 are shown.

Figure 10:
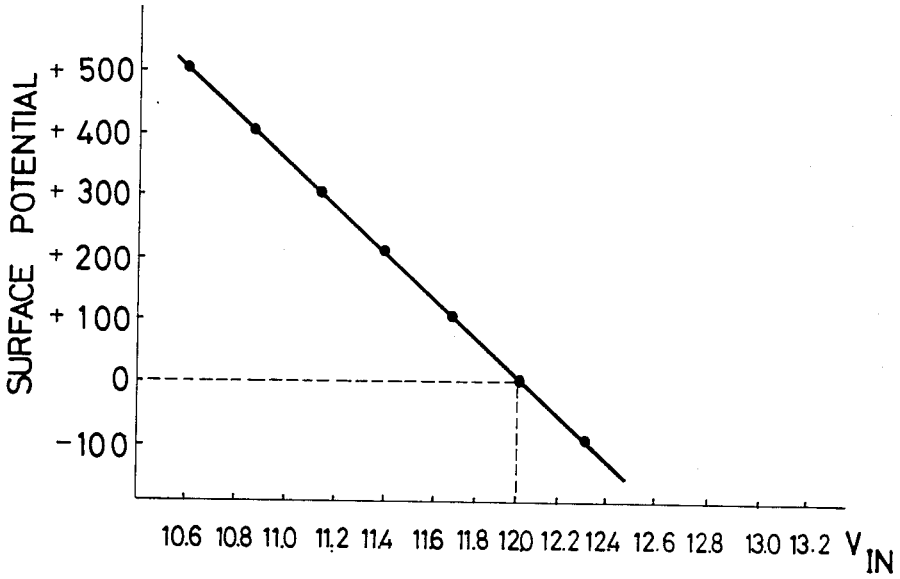
FIG. 10 is a chart showing the relationship between the surface potential and the detection signal detected by a potential sensor.

Also FIG. 10 shows the relationship between the surface potential of the recording member 6 and the detection signal from the potential sensor 10.

In case the surface potential $V_X$ of the recording member 6 is equal to 0 V, the potential sensor 10 provides a detection signal $V_{IN}$ equal to 12 V, and the detection signal $V_{IN}$ is given by an equation $V_{IN}=12V-V_X/350$. Said detection signal $V_{IN}$ is integrated by an integrating circuit I1 composed of the resistor R1, condenser C1 and operational amplifier Q1. If a potential exceeding a determined threshold value lasts in excess of a predetermined period in the course of said integration, such potential is integrated during the duration thereof by signal output means comprising an integrating circuit I2 composed of the resistor R7, condenser C2 and operational amplifier Q3. The output signals of said integrating circuits I1, I2 are subjected to addition/subtraction in the operational amplifier Q2, of which output signal is released as the control signal $V_{OUT}$ for controlling the developing bias.

Correction means including comparator Q5 and its related circuitry is used for detecting the predetermined potential. A timer circuit composed of the resistor R5, consenser C3 and comparator Q6 is used for identifying the continuation of a potential exceeding the threshold value over a predetermined period, and controls the active period of the integrating circuit I2 by controlling the gate of the FET Q7.

When the surface potential $V_X$ of the recording member 6 becomes higher than the threshold value, the detection signal $V_{IN}$ becomes lower than V2 to provide a high-level signal from the comparator Q5, thereby activating the aforementinoned timer circuit. In case a potential exceeding the threshold value continues for a determined period, the comparator Q6 releases a high-level signal to turn on the FET Q7, whereby the integrating circuit I2 integrates the signal corresponding to the surface potential and elevates the output signal. Said output signal is inversion amplified in an inverting amplifier composed of the resistors R9, R10 and operational amplifier Q4, thus reducing the output of the integrating circuit I1.

In this manner the detection signal is omitted in case the image density exceeding the threshold value continues over a determined width.

Switches SW1, SW2 are used for resetting the integrating circuits I1, I2 prior to the start of image reading. Said switches SW1, SW2 may be turned on by the actuation of the copy start key, or at the completion of the measurement of the original image density.

FIG. 9B shows another example of the limiter circuit, in which the same components as those in FIG. 9A are represented by the same numbers. In FIG. 9B there are further shown operational amplifiers Q7, Q8, and a transistor Q9.

In this example, in case a potential exceeding the threshold value continues over a determined period, the output signal of the integrating circuit I2 turns on the transistor Q9, whereby a current $i=\Delta V/R13$ corresponding to the output of said integrating circuit I2 is given to the resistor R13.

Assuming that the output of the integrating circuit I1 is Vr and the input to the operational amplifier Q7 is Vr', there is obtained a relation:

$$Vr'=Vr-iR2$$

whereby the output of the integrating circuit I1 decreases according to said current i.

It is therefore rendered possible to omit the detection signal in case an original density exceeding the threshold value continues over a determined width.

As explained in the foregoing, it is rendered possible to always obtain the reproduced images of an appropriate density by the use of detecting means for detecting, in the course of original scanning, the continuation of the image density exceeding a determined value over a determined width, thus enabling exact measurement of the original background density.

In the foregoing embodiment the original image density is detected by the measurement of the potential on the recording member, but the image density measurement can also be achieved by detecting the amount of light coming from the original.

Also the image density measurement may be conducted over the entire area of the original or in a part thereof.

What we claim is:

1. An image recording apparatus comprising:

image recording means for image recording on a recording member according to an original;

detecting means for detecting the image density of the original;

control means for controlling the image recording conditions of said image recording means in response to data released from said detecting means;

signal output means for releasing a signal upon detection, by said detecting means, of the continuation of the image density exceeding a determined value over a determined width; and correcting means for correcting data supplied from said detecting means to said control means, in response to the signal released from said signal output means.

2. An image recording apparatus according to claim 1, wherein said correcting means is adapted to correct the data released from said detecting means in such a manner as to skip data corresponding to the image density continuing over said determined width.

3. An image recording apparatus according to claim 1, wherein said correcting means is adapted to correct the data released from said detecting means in such a manner as to convert data corresponding to the image density continuing over said determined width into other specified data.

4. An image recording apparatus according to claim 3, wherein said specified data are data corresponding to the background density of the original.

5. An image recording apparatus according to claim 1, wherein said image recording means comprises latent image forming means for forming an electrophotographic latent image on said recording member, and a developing unit for developing said electrostatic latent image, and wherein said control means is adapted to control the bias voltage supplied to said developing unit.

6. An image recording apparatus according to claim 1, wherein said detecting means is adapted to detect the original image density through said recording member.

7. An image recording apparatus according to claim 6, wherein said image recording means comprises latent image forming means for forming an electrostatic latent image on said recording member and developing means for developing said electrostatic latent image, and said detecting means comprises a sensor for detecting the surface potential on said recording member.

8. An image recording apparatus according to claim 7, wherein said detecting means comprises integrating means for integrating the output of said sensor, and said control means is adapted to control said image recording conditions in response to the output data of said integrating means.

9. An image recording apparatus comprising:

image recording means for image recording on a recording member according to an original;

detecting means for detecting the image density of the original; and control means for controlling the image recording conditions of said image recording means in response to data released from said detecting means;

wherein said control means is adapted to correct the data released from said detecting means in the event that the image density exceeding a predetermined value continues over a predetermined width.

10. An image recording apparatus according to claim 9, wherein said control means is adapted to correct the data released from said detecting means in such a manner as to skip data corresponding to the image density continuing over said predetermined width.

11. An image recording apparatus according to claim 9, wherein said control means is adapted to correct the data released from said detecting means in such a manner as to convert data corresponding to the image density continuing over said predetermined width into other specified data.

12. An image recording apparatus according to claim 11, wherein said specified data are data corresponding to the background density of the original.

13. An image recording apparatus according to claim 9, wherein said image recording means comprises latent image forming means for forming an electrophotographic latent image on said recording member, and a developing unit for developing said electrostatic latent image, and wherein said control means is adapted to control the bias voltage supplied to said developing unit.

14. An image recording apparatus according to claim 9, wherein said detecting means is adapted to detect the original image density through said recording member.

15. An image recording apparatus according to claim 14, wherein said image recording means comprises latent image forming means for forming an electrostatic latent image on said recording member and developing means for developing said electrostatic latent image, and said detecting means comprises a sensor for detecting the surface potential on said recording member.

16. An image recording apparatus according to claim 15, wherein said detecting means comprises integrating means for integrating the output of said sensor, and said control means is adapted to control said image recording conditions in response to the output data of said integrating means.

* * * * *